US008408927B2

(12) United States Patent
Tashiro

(10) Patent No.: US 8,408,927 B2
(45) Date of Patent: Apr. 2, 2013

(54) FLOATING CONNECTOR WITH FLEXIBLE CONDUCTIVE MEMBER

(75) Inventor: Harunori Tashiro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/264,804

(22) PCT Filed: Apr. 23, 2010

(86) PCT No.: PCT/JP2010/057236

§ 371 (c)(1),
(2), (4) Date: Oct. 17, 2011

(87) PCT Pub. No.: WO2011/016272

PCT Pub. Date: Feb. 10, 2011

(65) Prior Publication Data

US 2012/0040553 A1 Feb. 16, 2012

(30) Foreign Application Priority Data

Aug. 3, 2009 (JP) ..... 2009-180451

(51) Int. Cl.
*H01R 13/64* (2006.01)

(52) U.S. Cl. ..... 439/247

(58) Field of Classification Search ..... 439/246–248
See application file for complete search history.

(56) References Cited

U.S. PATENT DOCUMENTS

| | | | | |
|---|---|---|---|---|
| 5,971,791 | A | 10/1999 | Itoh et al. | |
| 6,065,991 | A * | 5/2000 | Fukuda | 439/352 |
| 6,186,810 | B1 | 2/2001 | Barnabe et al. | |
| 2005/0265848 | A1 * | 12/2005 | Tseng | 416/210 R |
| 2008/0261428 | A1 * | 10/2008 | Brodeur | 439/246 |
| 2008/0274634 | A1 * | 11/2008 | Kabasawa et al. | 439/247 |
| 2012/0040553 | A1 * | 2/2012 | Tashiro | 439/359 |

FOREIGN PATENT DOCUMENTS

| | | | |
|---|---|---|---|
| DE | 102007058243 | A1 | 6/2009 |
| EP | 1 653 568 | A1 | 5/2006 |
| JP | 10-074556 | A | 3/1998 |
| JP | 10-074557 | A | 3/1998 |
| JP | 2000-082518 | A | 3/2000 |
| JP | 2000-277217 | A | 10/2000 |
| JP | 2003-272763 | A | 9/2003 |
| JP | 2007-087682 | A | 4/2007 |

OTHER PUBLICATIONS

European Search Report for Application No. 10806272.0-1231/246395 Nov. 15, 2012.

* cited by examiner

*Primary Examiner* — James Harvey
(74) *Attorney, Agent, or Firm* — Sughrue Mion, PLLC

(57) ABSTRACT

There is provided a connector 1 connected to a mating connector, fixed in a case of a motor, comprising: an outer housing 5 attached to the case; a first inner housing 6 accommodating a first terminal 20 engaging to the mating connector, being accommodated in the outer housing 5 movably in the engaging direction Y of the first terminal 20 and in the intersectional direction of the engaging direction Y; a first inner connector 6 engaging to the mating connector; a second inner housing 10 accommodating a second terminal 11 electrically connected to a electric circuit in the case and being fixed in the outer housing 5 and a braided wire 90, and further including a connection portion 9 connecting the first terminal 20 and the second terminal 11 and a packing 7 attached to the first inner housing.

16 Claims, 11 Drawing Sheets

FLOATING CONNECTOR WITH FLEXIBLE CONDUCTIVE MEMBER

CROSS REFERENCE TO RELATED APPLICATIONS

This application is a National Stage of International Application No. PCT/JP2010/057236, filed on Apr. 23, 2010, which claims priority from Japanese Patent Application No. 2009-180451, filed Aug. 3, 2009, the contents of all of which are incorporated herein by reference in their entirety.

BACKGROUND OF THE INVENTION

1. Field of the Invention

The present invention relates to a connector used for connecting electric devices to each other.

2. Description of the Related Art

Various electric devices are mounted in an automobile. A conventional wire harness has been used for connecting these electric devices to each other. The wire harness comprises a plurality of electric wire and a plurality of connectors attached to the ends of the electric wire. Each connection of the wire harness to a receiving connector fixed to a case of each electric device allows the electric devices to connect to each other. Note that the receiving connector is referred to as a connector fixed to a panel or a case.

When the electric devices are connected each other by using large-diameter electric wire such as power source wire, however, it is difficult to form the large-diameter electric wire, and therefore more difficult to wire the large-diameter electric wire inside a restricted vehicle space. In addition, because the large-diameter electric wire require large bend radius, a large space is required for accommodating the electric wire.

In view of this, direct connection without wire harness has been considered recently. In this case, because receiving connectors of each electric device are directly connected to each other, the receiving connectors require a structure to absorb misregistration between the receiving connectors which are to be connected to each other (i.e., misregistration by assembly error or component tolerance). Further, in case of heavy weight of the electric devises, because large impact load to the receiving connectors at the time of engaging with each other may damage the receiving connectors, the receiving connectors require a structure to absorb the impact load at the time of engaging.

Proposed as the receiving connectors provided with a structure to absorb the misregistration or the impact load is a floating connector shown, e.g., in patent document 1 (Japanese Unexamined Patent Application Publication No. 2000-277217). As shown in FIG. 12, the floating connector 201 includes, a terminal 210 connected to a termination of an electric wire 207, an inner housing 204 accommodating the terminal 210, an outer housing 203 movably accommodating the inner housing 204, a spring washer 202 that is arranged between the inner housing 204 and an inner bottom surface 203*a* in the outer housing 203, and biases the inner housing 204 in the direction toward a mating connector, and allows the inner housing 204 to be movably attached within the outer housing 203. Further, the electric wire 207 is passed through a through-bore 205 provided in the inner bottom surface 203*a* of the outer housing 203, and derived outside the floating connector 201.

In the floating connector 201, the spring washer 202 is elastically deformed so that the terminal 210 is connected to the terminal of the mating connector at the time of engaging, and therefore the inner housing 204 moves within the outer housing 203 to absorb the misregistration between the inner housing 204 and the mating connector. Further, the spring washer 204 absorbs the impact load applied to the inner housing 204 by engaging with the mating connector.

[Patent Document 1] JP, A, 2000-277217

SUMMARY OF THE INVENTION

Problems to be Solved by the Invention

However, in the floating connector 201 as the receiving connector shown in the patent document 1, the inner housing 204 and terminal 210 move at the time of engaging with the mating connector, and therefore the electric wire 207 connected to the terminal 210 moves, and in the result, there has been a problem that electric parts connected to the electric wire 207 might be subjected to stress, or connection reliability between the electric wire and the electric parts might decrease.

Further, the floating connector 201 as the receiving connector shown in the patent document 1 is configured to maintain the connection between the terminal 210 and the terminal of the mating connector by only biasing force, or elastic force of the spring washer, and therefore aging degradation or settling may cause elastic force of the spring washer 202 to decrease, and in the result, there has been a problem that it is difficult to maintain the connection reliability between the terminal 210 and the mating connector for long periods.

From view of the problems as above, the object of the invention is to provide a connector that is able to absorb misregistration with the mating connector and maintain connection condition to the electric circuit to be attached in a case.

Means for Solving the Problems

In order to attain the object, according to the present invention recited in claim 1, there is provided a connector, comprising: a outer housing attached to a case; a first inner housing that accommodates a first terminal engaging with terminal in a mating connector and is movably accommodated within the outer housing along the engaging direction of the first terminal and the intersectional direction of the engaging direction, and engages with the mating connector; a second inner housing that accommodates a second terminal connected to an electric circuit in the case and is fixed within the outer housing; a connection portion that is made of flexible conductive member and electrically connects between the first terminal and the second terminal.

According to the present invention recited in claim 2, there is provided the outer housing in the invention recited in claim 1 that further comprises: a first housing portion that is formed capable of the first inner housing and in the shape of tube with bottom and is provided with a through-bore through which the connection portion is passed through in the bottom wall, and further includes an elastic deformable packing that is attached to the first inner housing, integrally having a packing body in the shape of tube pressed fit between the outer circumference of the first inner housing and the inner circumference of the first housing, and a annular cover positioned between the lower end surface of the first inner housing and the bottom wall of the first housing.

According to the present invention recited in claim 3, in the invention recited in claim 1 wherein the connector includes a plurality of the first terminals, a plurality of the second terminals, and a plurality of the connection portion electrically connecting between the first terminals and the second terminals respectively, and further includes a plurality of isolation tubes formed telescopically in the tubular shape with bellows, made of isolation material, and accommodating each connection portion respectively.

According to the present invention recited in claim 4, in the invention recited in claim 2 wherein the connector includes a plurality of the first terminals, a plurality of the second terminals, and a plurality of the connection portion electrically connecting between the first terminals and the second terminals respectively, and further includes a plurality of isolation tubes formed telescopically in the tubular shape with bellows, made of isolation material, and accommodating each connection portion respectively.

According to the present invention recited in claim 5, in the invention recited in claim 1 wherein the connector includes a plurality of the first terminals, a plurality of the second terminals, and a plurality of the connection portion electrically connecting between the first terminals and the second terminals respectively, and further includes a plurality of isolation tubes formed telescopically in the tubular shape with bellows, made of isolation material, and accommodating each connection portion respectively.

According to the present invention recited in claim 6, in the invention recited in claim 2 wherein the outer housing includes a first outer housing accommodates the first inner housing and a second outer housing that accommodates the second inner housing, and is fixed in the case, and is attached to the first outer housing movably along the engaging direction of the first terminals, an elastic member biasing the other in the direction away from the one along the engaging direction of the first terminal is attached to one of the first outer housing and the second outer housing.

According to the present invention recited in claim 7, in the invention recited in claim 3 wherein the outer housing includes a first outer housing accommodates the first inner housing and a second outer housing that accommodates the second inner housing, and is fixed in the case, and is attached to the first outer housing movably along the engaging direction of the first terminals, an elastic member biasing the other in the direction away from the one along the engaging direction of the first terminal is attached to one of the first outer housing and the second outer housing.

According to the present invention recited in claim 8, in the invention recited in claim 4 wherein the outer housing includes a first outer housing accommodates the first inner housing and a second outer housing that accommodates the second inner housing, and is fixed in the case, and is attached to the first outer housing movably along the engaging direction of the first terminals, an elastic member biasing the other in the direction away from the one along the engaging direction of the first terminal is attached to one of the first outer housing and the second outer housing.

According to the present invention recited in claim 9, in the invention recited in claim 1 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

According to the present invention recited in claim 10, in the invention recited in claim 2 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

According to the present invention recited in claim 11, in the invention recited in claim 3 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

According to the present invention recited in claim 12, in the invention recited in claim 4 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

According to the present invention recited in claim 13, in the invention recited in claim 5 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

According to the present invention recited in claim 14, in the invention recited in claim 6 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

According to the present invention recited in claim 15, in the invention recited in claim 7 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

According to the present invention recited in claim 16, in the invention recited in claim 8 wherein a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement.

Advantageous Effects of Invention

According to the present invention recited in claim 1, since the connector includes a outer housing attached to a case;

a first inner housing that accommodates a first terminal engaging with terminal in the mating connector and is movably accommodated within the outer housing along the engaging direction of the first terminal and the intersectional direction of the engaging direction, and engages with the mating connector; a second inner housing that accommodates a second terminal connected to an electric circuit in the case and is fixed within the outer housing; a connection portion that is made of flexible conductive member and electrically connects between the first terminal and the second terminal, the second terminal does not move even if the first inner housing and the first terminal move by engagement of the mating connector with the first inner housing, making it possible to prevent from producing stress in the electric circuit in the case electrically connected to the second terminal or decreasing the connection reliability between the second terminal and the electric circuit. Accordingly there is provided a connector that is able to absorb the misregistration with the mating connector and maintain connection condition to the electric circuit to be mounted in the case. Further, no need for electric wire to connect to the mating connector saves the accommodating space to accommodate the electric wire.

According to the present invention recited in claim 2, since the outer housing in the invention recited in claim 1 includes a first housing portion that is formed capable of the first inner housing and in the shape of tube with bottom and is provided with a through-bore through which the connection portion is passed through in the bottom wall, and further includes an elastic deformable packing that is attached to the first inner housing, integrally having a packing body in the shape of tube pressed fit between the outer circumference of the first inner housing and the inner circumference of the first housing and a annular cover positioned between the lower end surface of the first inner housing and the bottom wall of the first housing, there can be absorbed by the packing the misregistration between the mating connector and the first inner housing and the impact load applied to the first inner housing at the time of engagement between the mating connector and the first inner housing.

According to the present invention recited in claims 3 and 4, since the connector includes a plurality of the first terminals, a plurality of the second terminals, and a plurality of the connection portion electrically connecting between the first terminals and the second terminals respectively, and further includes a plurality of isolation tubes formed telescopically in the tubular shape with bellows, made of isolation material, and accommodating each connection portion respectively, a plurality of the connection portions that transform and move according to movement of the first inner housing and the first terminals can be isolated each other by the isolation tubes.

According to the present invention recited in claims 5 to 8, since the outer housing includes a plurality of the first terminals, a plurality of the second terminals, and a plurality of the connection portion electrically connecting between the first terminals and the second terminals respectively, and further includes a plurality of isolation tubes formed telescopically in the tubular shape with bellows, made of isolation material, and accommodating each connection portion respectively, the misregistration can be absorbed by contraction of the elastic material when the mating connector is misregistered to the connector or the connector is misregistered to the mating connector by assembly error.

According to the present invention recited in claims 9 to 16, since a nut is attached to the first inner housing, and the mating connector approaches the first inner housing as a bolt passed through a bore provided in the mating connector ingresses into the nut, and fastening the bolt to the nut allows the mating connector terminals and the first terminals to engage each other, and maintains the engagement, electric connection between terminal of the mating connector and the first terminal can be secured. Further, the engagement between the terminal of the mating connector and the first terminal can be secured if the engagement between the terminal of the mating connector and the first terminal cannot be checked visually. Further, the connection reliability between the terminal of the mating connector and the first terminal can be maintained for long periods.

DETAILED DESCRIPTION OF THE PREFERRED EMBODIMENTS

Figure 1:
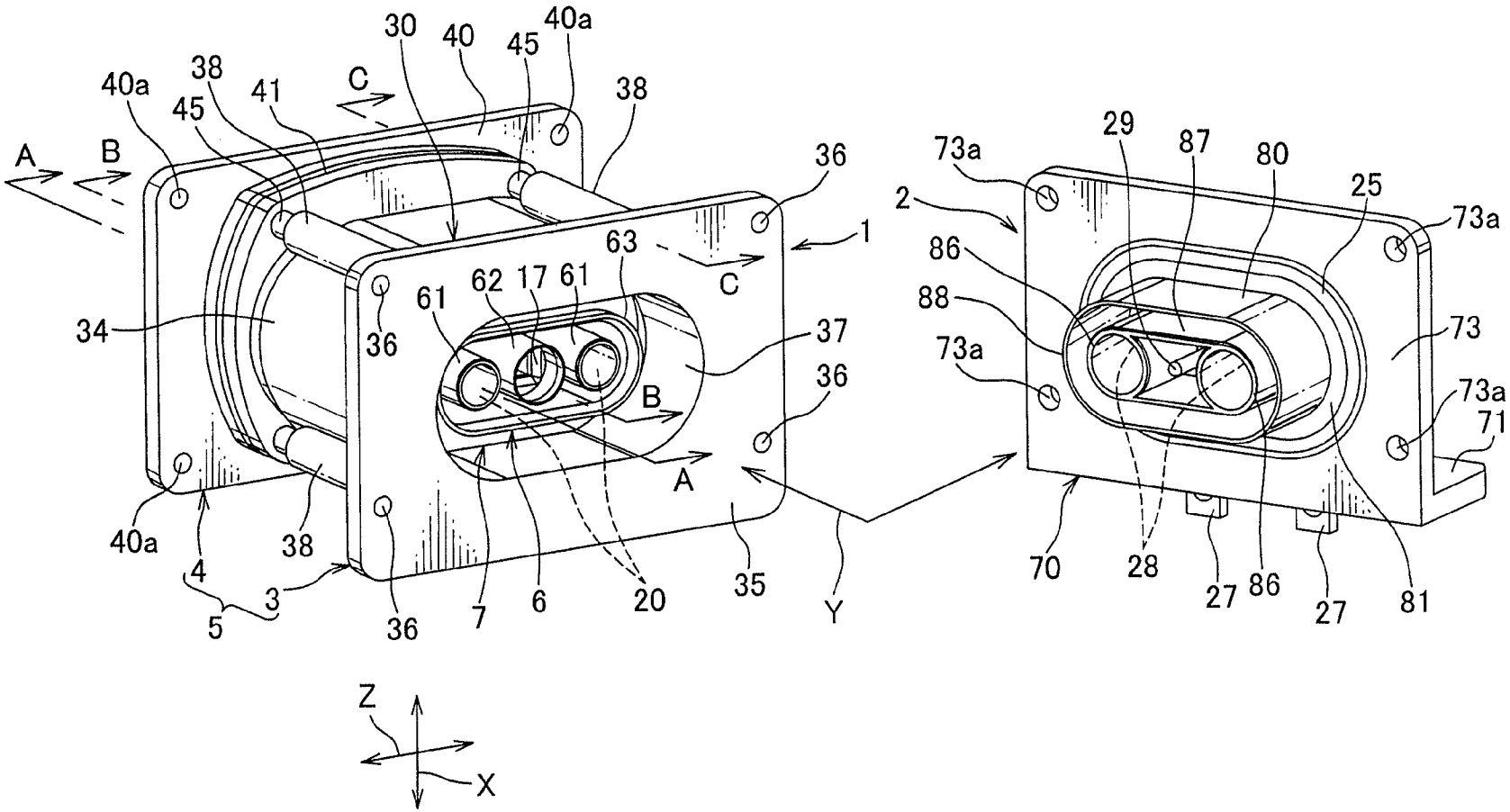
FIG. 1 is a perspective view illustrating a connector and a mating connector according to a first embodiment.

Hereafter, a connector according to a first embodiment in the invention is described with reference to FIGS. 1 to 11.

A connector 1 according to the invention is mounted in an inverter case attached to an automobile and is a receiving connector that is connected to a mating connector 2 attached to a motor case. In case that the inverter is mounted in the motor, the connector 1, i.e., is a receiving connector that is directly connected to the mating connector provided integrally with the motor.

An arrow Y shows a direction of an engagement between the mating connector and the connector 1, and a allow X shows a width direction of orthogonal oriented direction to the engaging direction and a allow Z shows a length direction of orthogonal oriented direction to the engaging direction.

The mating connector 2 mentioned above, as shown in FIGS. 1 and 6, includes a aluminum shield case 70 attached to the motor case, a synthetic-resin connector 80 mounted in the shield case, a pair of a female-type terminal 28 accommodated in the connector body 28, a pair of bus bars 27 electrically connecting between the terminals 28 and a electric circuit in the motor respectively, packing 23, 24, 25, and 26.

Figure 7:
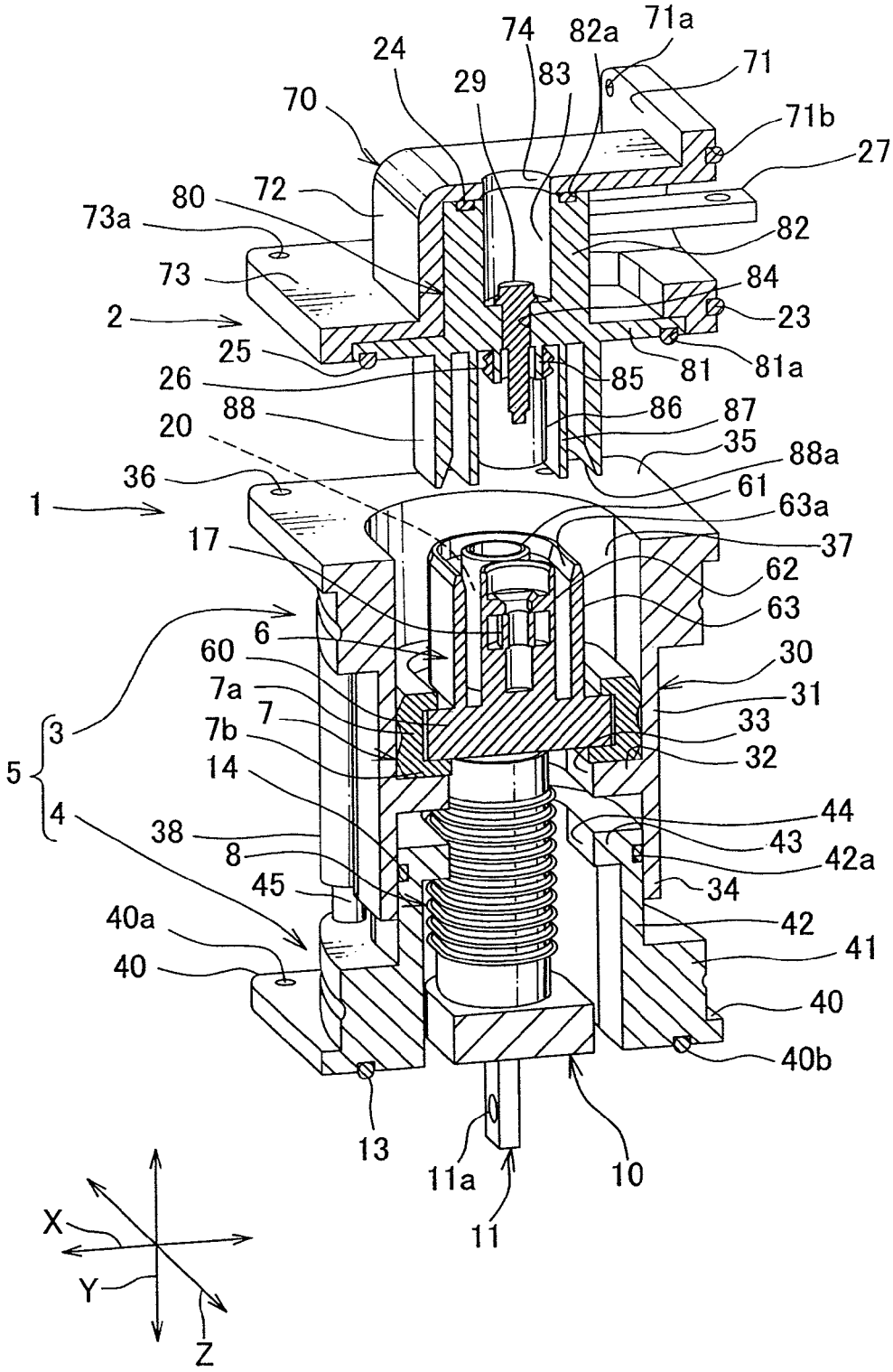
FIG. 7 is a sectional perspective view illustrating the state prior to engagement between the connector and the mating connector shown in FIG. 1.

The shield case mentioned above 70 includes integrally an annual attachment portion 71 that is stacked on an outer surface of the motor case, and fixed to the case with a bolt, a connector body housing tubularly extending from the attachment portion 71, a flange 73 provided on the end side away from the attachment portion 71 of the connector body housing 72 in the shape of collar. The shield case 70 intercepts electromagnetic wave such as noise to electromagnetically shield the connector body 80. A symbol 71*a* shown in FIG. 7 is a bore the bolt passes through to fix the attachment portion 71 to the case. A symbol 73*a* shown in FIG. 7 is a bore a bolt passes through to fix the flange 73 and a flange 35 described below of the connector 1 each other.

The connector body 80 mentioned above includes integrally a plate-like overlap portion 81 stacked on the flange 73 mentioned above, a stand portion 82 that stands from the one surface of the overlap portion 81 and is accommodated in the connector body housing 72, a pair of a terminal housing 86 that stands cylindrically from the other surface of the overlap portion 81 and accommodates each of the terminal 28, a bolt housing that stands cylindrically from the other surface of the overlap portion 81 and is arranged between a pair of the terminal housings 86, an inner tube 87 that stands cylindrically from the other surface of the overlap portion 81 and is arranged outside a pair of the terminal housings 86 and bolt housing 85, an outer tube 88 that stands cylindrically from the other surface of the overlap portion 81 and is arranged outside the inner tube 87. One portion of the outer circumference of the pair of the terminal housings 86 connects one of the inner circumferences of the inner tube 87. The inner tube 87 and the outer tube 88 are spaced each other. As shown in FIG. 7, a taper surface 88*a* is formed on a tip portion away from the side of the overlap portion 81 of the outer tube 88.

A pair of bus bar 27 is formed through injection molding on the stand portion 82. As shown in FIG. 7, the stand portion 82 is provided with a recess 83 formed concavely from the outer surface and a bore 84 formed concavely from the bottom of the recess 83 and connected to the inner of the bolt housing 85. On the bottom of the recess 83, the top of a bolt 29 for engagement fastened with a nut 17 of the connector 1 mentioned below is positioned. The bore 84 is passed through the axis portion of the engagement bolt 29. The tip of the axis of the engagement bolt 29 passed through the bore 84 is passed through the bolt housing 85 and positioned in the inner tube 87. An overlap portion with which the recess 83 of the connector body housing 72 overlaps is provided with a through-bore 74 for inserting the engagement bolt 29 and a tool such as a driver for rotating the engagement bolt 29.

The packing 23 is formed annularly with an elastic transformative rubber and the like, and mounted in the annular slot 71*b* provided on the outer end of the attachment portion 71 as shown in FIG. 7, which keeps watertight between the attachment portion 71 and the outer surface of the motor case. Therefore this makes it possible to prevent liquid such as water from entering into the connector body housing 72 from between the attachment portion 71 and the motor case.

The packing 24 is formed annularly with an elastic transformative rubber and the like, and mounted in the annular slot 82*a* provided on the outer circumference of the recess 83 of the stand portion 82 as shown in FIG. 7, which keeps watertight between the stand portion 82 and the connector body housing 72. Therefore this makes it possible to prevent liquid such as water from entering into the connector body housing 72 from the through-bore 74.

Figure 9:
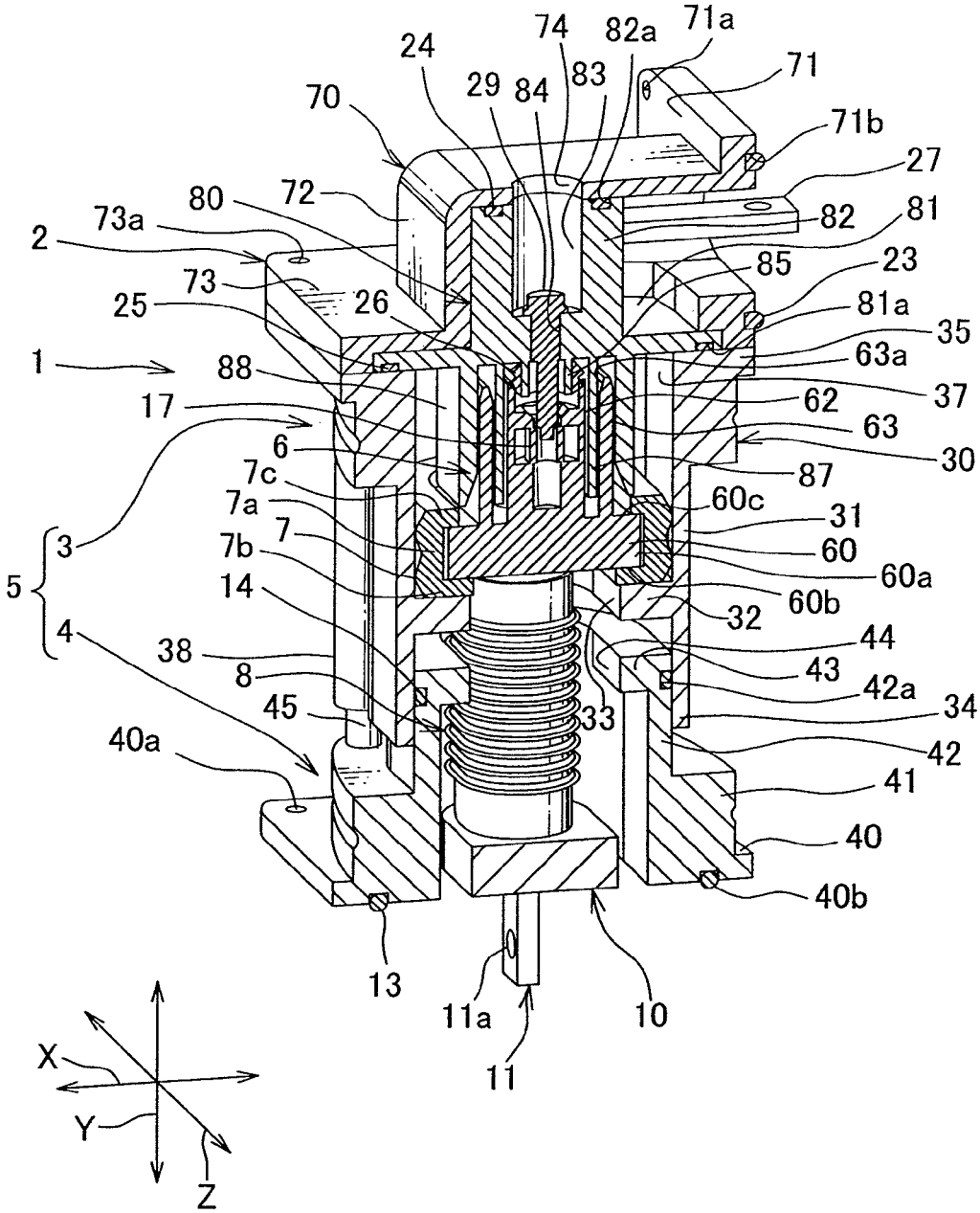
FIG. 9 is a sectional perspective view illustrating the state in which the mating connector shown in FIG. 8 additionally approaches the connector.

The packing 25 is formed annularly with an elastic transformative rubber and the like, and mounted in the annular slot 81*a* provided on the outer edge of the overlap portion 81 as shown in FIG. 9, which keeps watertight between the overlap portion 81 and the flange 35. Therefore this makes it possible to prevent liquid such as water from entering into a first outer housing 3 of the connector 1 mentioned below from between the overlap portion 81 and the flange 35.

Figure 11:
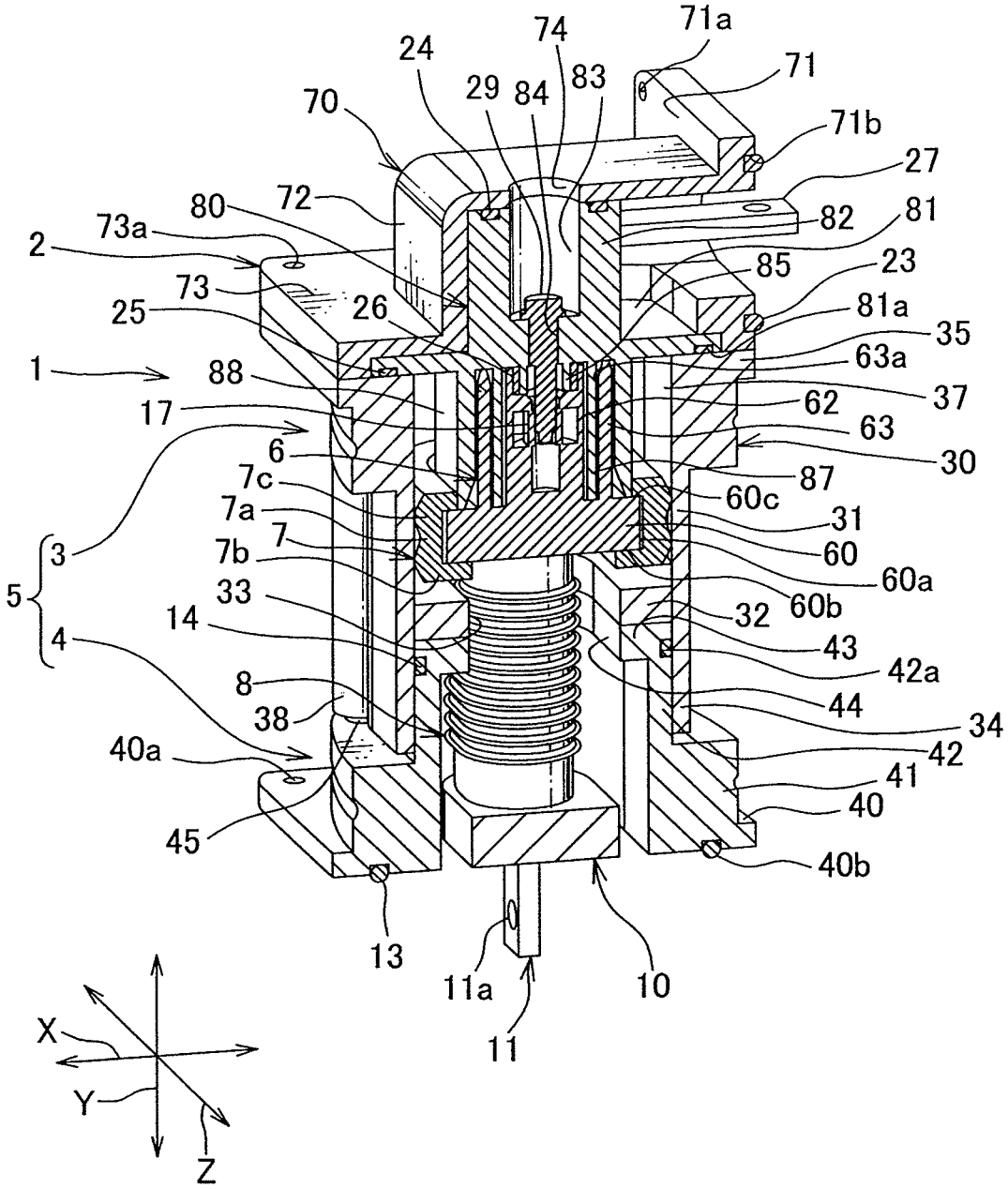
FIG. 11 is a sectional perspective view illustrating the state in which the first inner housing has been pulled up to the mating connector after a bolt and a nut are fastened altogether shown in FIG. 10.
Figure 12:
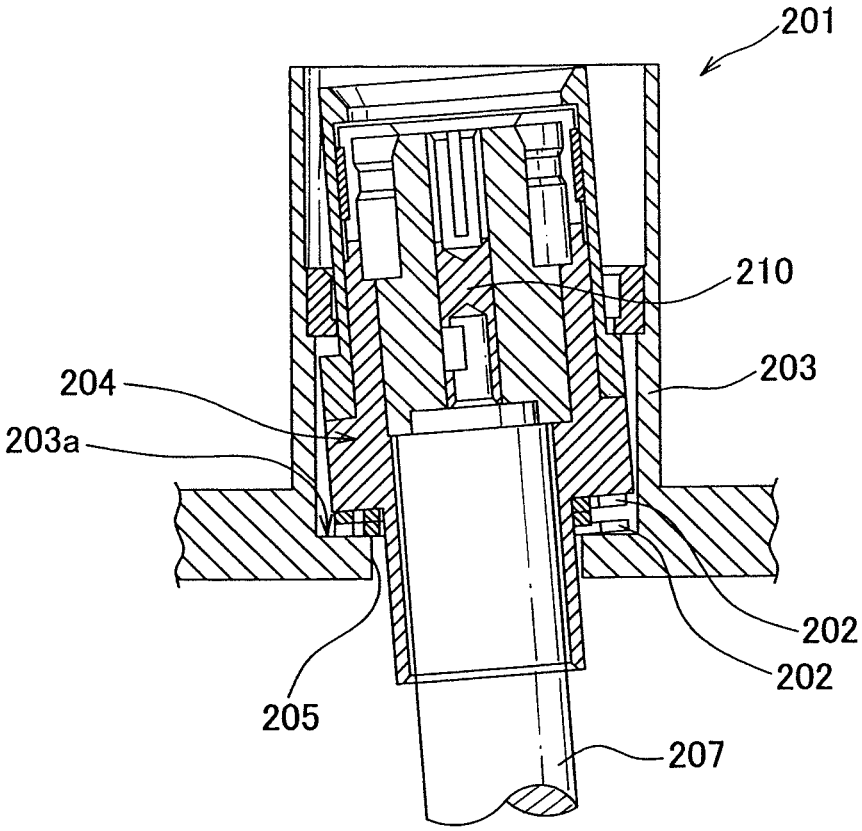
FIG. 12 PRIOR ART
FIG. 12 is a sectional view illustrating a conventional connector.

The packing 26 is formed annularly with an elastic transformative rubber and the like, and mounted on the outer circumference surface of the bolt housing 85 as shown in FIG. 11, which keeps watertight between the bolt housing 85 and a nut housing 62 of the connector 1 mention below. Therefore this makes it possible to prevent liquid such as water from entering into inner tube 87 from the through-bore 74, the recess 83, the bore 84 and the bolt housing 85.

Figure 2:
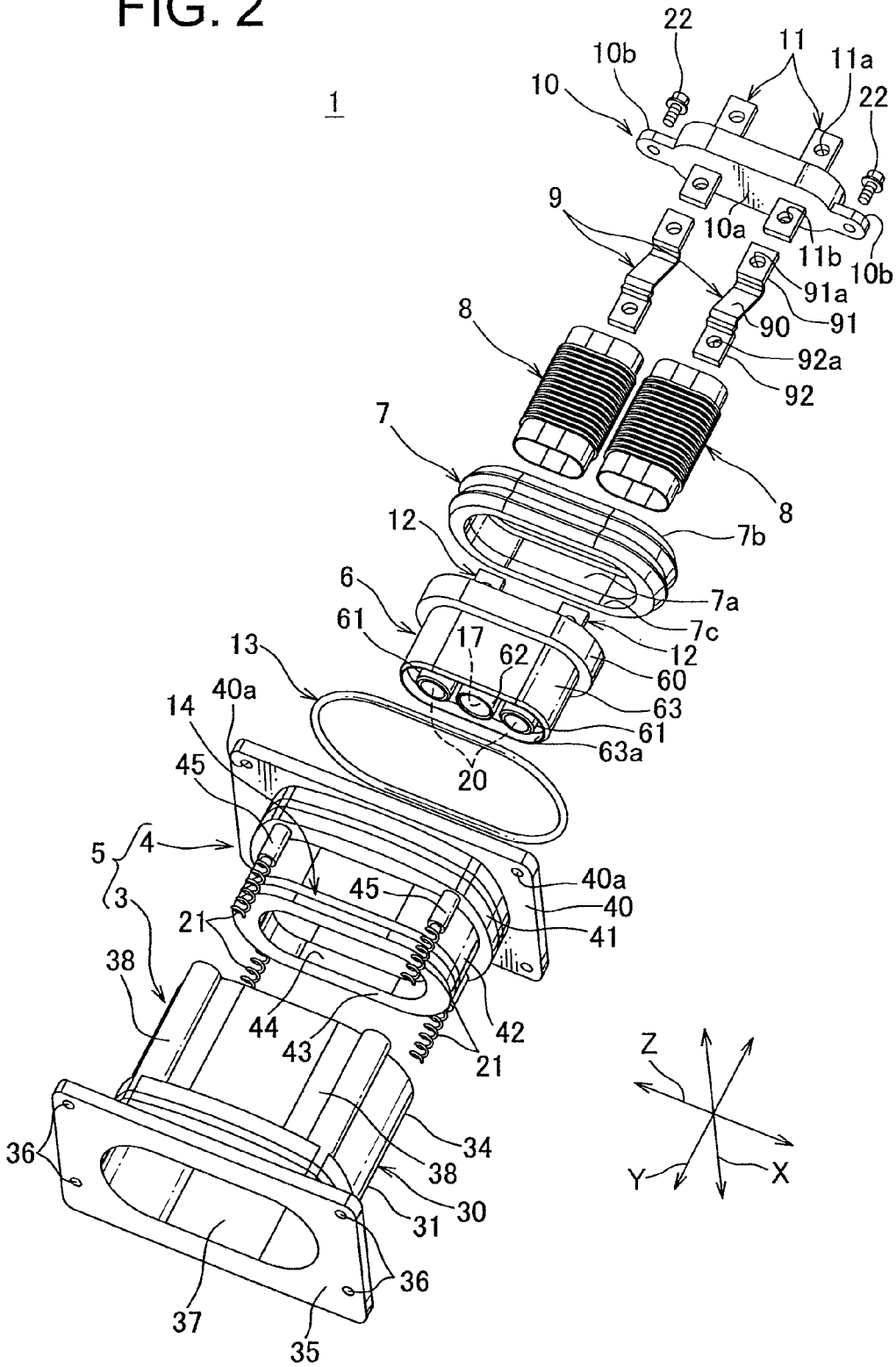
FIG. 2 is an exploded view of the connector shown in FIG. 1.

As shown in FIGS. 1 and 2, the connector 1 accommodates an outer housing 5 attached to the inverter case, a pair of first terminals engaged to a pair of female-type terminals 82 of the mating connector 2 electrically connected to the terminals 28, a pair of the first terminals 20 and includes in the outer housing 5 a first inner housing 6 that is accommodated movablely along the engaging direction Y of the first terminals 20 and the intersectional direction of the engaging direction Y, and engages with the mating connector 2, an elastic transformative packing 7 attached to the first inner housing 6, a pair of a second terminals 11 electrically connected to a electric circuit in the inverter case, a second inner housing 10 that accommodates a pair of the second terminals and is fixed in the outer housing 5, a pair of connection portion 9 that is configured with braided electric wire 90 as "conductive member with flexibility", and electrically connects the first terminals with the second terminals 11 respectively, a pair of isolate tube 8 that is formed telescopically in the tubular shape with bellows with isolate material and accommodates the connection portion 9 respectively, and packing 13 and 14.

As shown in FIG. 2, the outer housing 5 includes an aluminum first outer housing 3 accommodating the first inner housing 6, a second outer housing 4 that accommodates the second inner housing 10, and is fixed in the inverter case, and to which the first outer housing 3 is attached movably along the engaging direction Y of the first terminals. Attached to the second outer housing 4 is a coil spring 21 as "an elastic member" biasing the first outer housing 3 along the engaging direction Y of the first terminals 20 in the direction away from the second outer housing 4. The first outer housing 3 and the second outer housing 4 intercepts electromagnetic wave such as noise to electromagnetically shield portion between the mating connector 2 and the inverter case.

The first outer housing 3 is composed of a tubular peripheral wall 31, an opening 37 and a bottom wall 32 in the tubular shape with bottom, capable of the first inner housing 6, and includes integrally a first housing 30 provided with a through-bore 33 the connection portion 9 passes through in the bottom wall 32, a flange 35 extending in the shape of collar from the end side of the opening 37 of the first housing 30, a extending portion 34 that extends tubularly from the end side of the bottom wall 32 of the first housing 30 and is formed in the shape that the surfaces of an inner circumference and an outer circumference thereof are the same as of the inner circumference and outer circumference of the circumference wall 31, and four circular cylinder 38 provided on the outer circumference surface of the circumference wall 31.

As shown in FIG. 9, the flange 35 is stacked on and fixed to the flange 73 of the mating connector 2 with a bolt mentioned above. A bore 73*a* for passing the bolt through provided in the flange 73 is formed so as to be larger than a bore for passing a bolt through provided in the flange 35. Forming the bore 73*a* larger than the bore 36 thus makes it possible to absorb the misregistration between the mating connector 2 and the connector 1 (which is a misregistration by assembly error or component tolerance).

Figure 5:
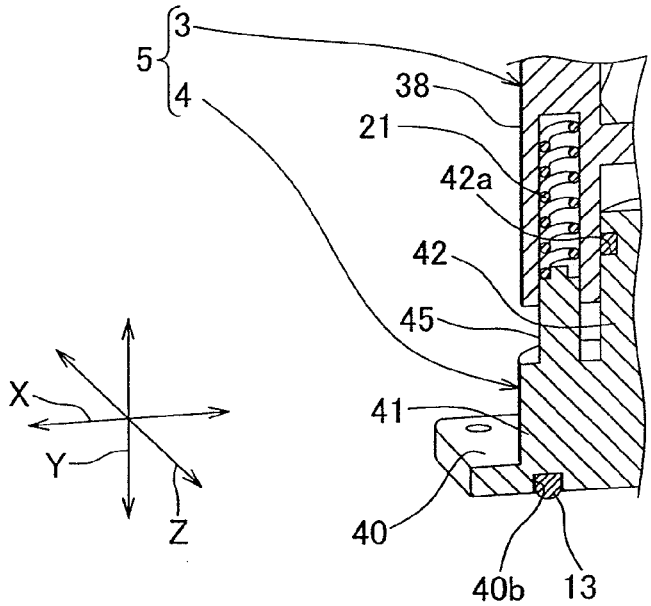
FIG. 5 is a sectional perspective view along C-C line in FIG. 1.
Figure 6:
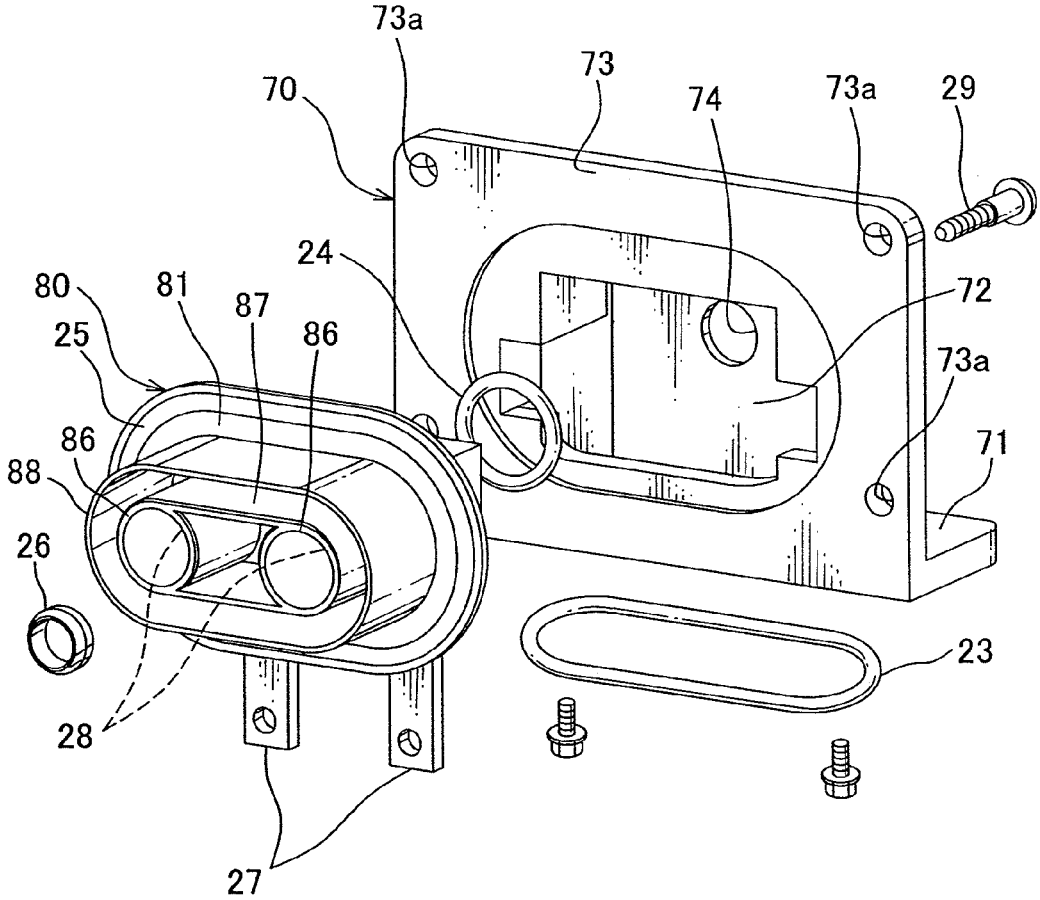
FIG. 6 is an exploded view of the mating connector shown in FIG. 1.

The four cylindrical tubes 38 are provided in the direction as each central axis becomes parallel to the central axis of the circumference wall 31. As shown in FIG. 5, the four cylindrical tubes 4 is cylindrically formed open to the second outer housing 38. These cylindrical tubes 38 accommodates movably the coil spring 21 and a columnar portion 45 the coil spring 21 is attached to mentioned above along the engaging direction Y.

Figure 3:
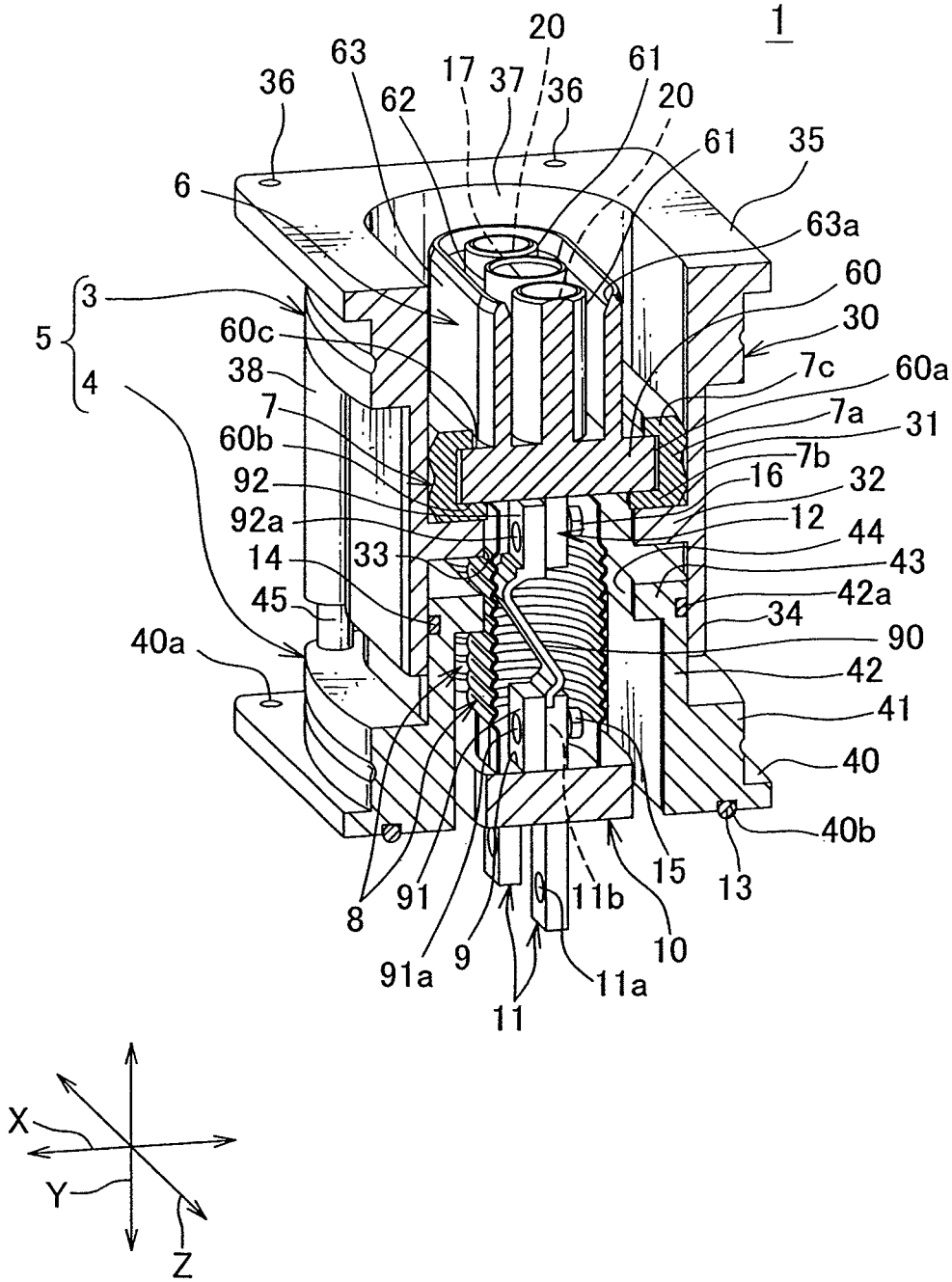
FIG. 3 is a sectional perspective view along A-A line in FIG. 1.

The second outer housing 4 includes integrally the annular attachment portion 40 that is stacked with the outer circumference of the inverter case, and fixed to the case with a bolt, a large diameter portion 41 that extends tubularly from the attachment portion 41, a small diameter portion 42 that extends tubularly from the end side away from the attachment portion 40 of the large diameter portion 41, an upper wall 43 stemming an opening of the small diameter portion 42, a through-bore 44 provided through the upper wall 43 through which the connection portion 9 passes, four columnar portions 45 each of which stands in the columnar shape from the end side away from the attachment portion 40 of the large diameter portion 41. A symbol 40*a* in FIG. 3 is a bore through which a bolt for fixing the case to the attachment portion 40 passes. The external diameter of the small diameter portion 42 is configured to be smaller than that of the large diameter portion 41. The inner circumference surface of the small diameter 42 and the large diameter 41 are configured to be the same surface. The four columnar portions 45 are arranged outside the small diameter 42 and spaced each other. The coil spring 21 is arranged at the top end of each of the columnar portions 45.

Figure 4:
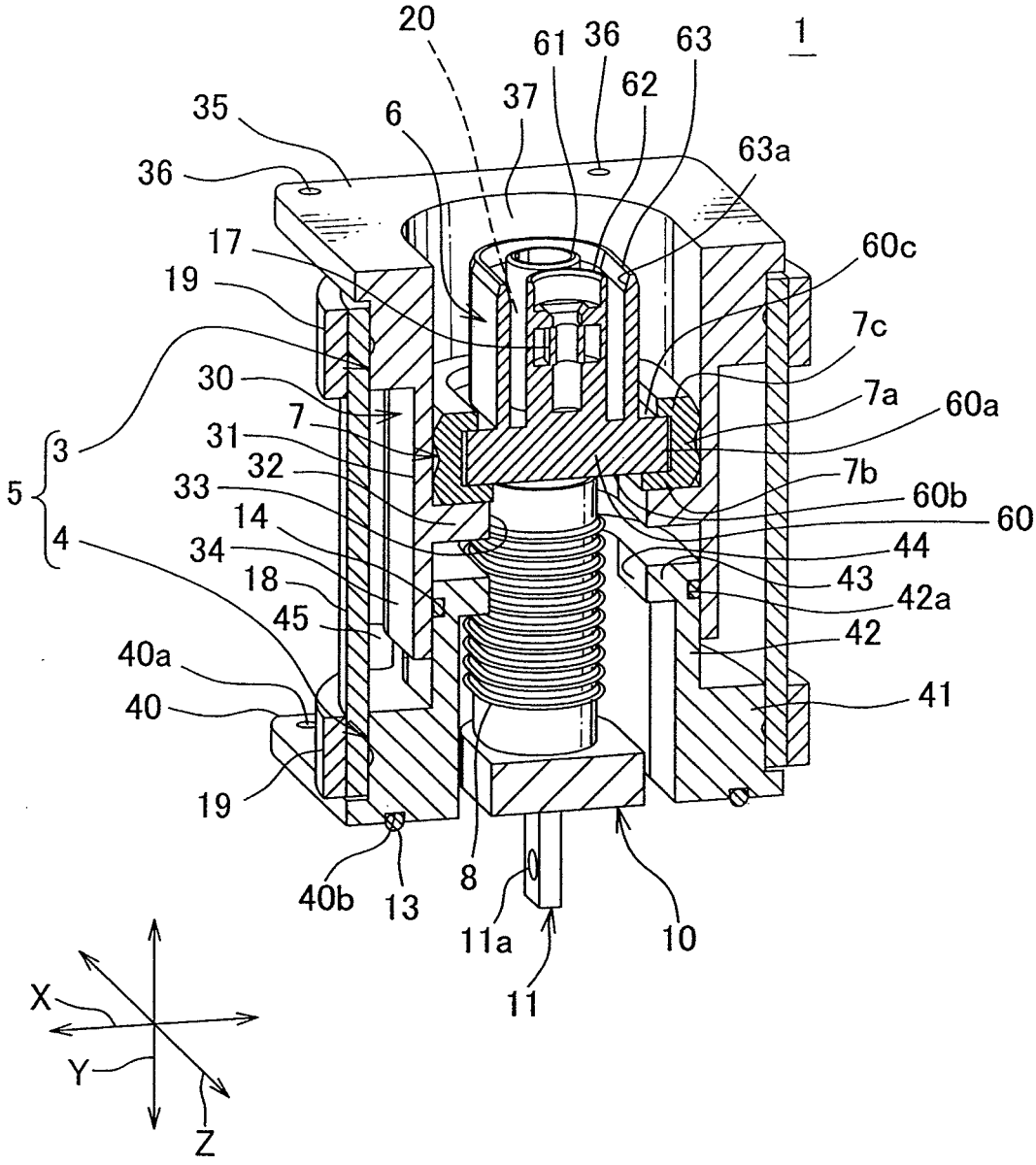
FIG. 4 is a sectional perspective view along B-B line in FIG. 1.

As shown in FIGS. 3 to 5, the small diameter portion 42 of the second outer housing 4 is inserted within the extending portion 34 of the first outer housing 3, and the coil spring 21 and the columnar portion 45 are inserted within the cylindrical portion 38, and therefore the first outer housing 1 and the second housing 4 are movably attached to each other in the engaging direction Y. The coil spring 21 contacts the bottom of the cylindrical portion 38 to bias the outer housing 3 in the direction away from the second housing 4, i.e., toward the mating connector 2. When the coil spring 21 absorbs the assembly error of the mating connector 2 or the connector 1, or attenuates the engagement load applied to the connector 1 by the connector 2, the coil spring 21 is constricted to move the first outer housing 3 toward the second outer housing 4.

The packing 13 is formed annularly with an elastic transformative rubber and the like, and mounted in the annular slot 40*b* provided on the outer edge of the attachment portion 40 as shown in FIG. 3, which keeps watertight between the attachment portion 40 and the outer surface of the motor case. Therefore this makes it possible to prevent liquid such as water from entering into the outer housing 5 from between the attachment portion 40 and the motor case.

The packing 14 is formed annularly with an elastic transformative rubber and the like, and mounted in the annular slot 42*a* provided on the outer circumference surface of the small diameter 42 as shown in FIG. 3, which keeps watertight between the outer circumference surface of the small diameter 42 and the inner circumference surface of the extending portion 34. Therefore this makes it possible to prevent liquid such as water from entering into the outer housing 5 from between the small diameter portion 42 and the extending portion 34.

As shown in FIG. 4, a braided shield 18 and a ring 19 are mounted in the outer housing 5. The braided shield 18 is braided with a plurality of conductive wire in the telescopical and tubular shape. One end of the braided shield 18 is stacked on the outer circumference surface of the circumference wall 31 of the first outer housing 3, and is crimped with the ring 19 to be fixed to the first outer housing 3. The other end of the braided shield 18 is stacked on the outer circumference surface of the large diameter portion 41 of the second outer housing 4, and is crimped with the ring 19 to be fixed to the second outer housing 4. The braided shield 18 therefore covers the outer housing 5. The braided shield 18 and the ring 19 intercept the electromagnetic wave such as noise to electromagnetically shield the outer housing 5.

The first terminals 20 are made of conductive metal material, and include a male-type engagement portion that is inserted into female-type terminals 28 of the mating connector 2, and plate portion 12 that is stretched from the engagement portion and configured in the plate shape. The plate portion 12 is stacked on the connection portion 9 and is fixed with a bolt 16 to be electrically connected to the connection portion 9.

The first inner housing 6 is made of synthetic resin, and includes integrally a base 60 configured ellipsoidally in the planar view and in the plate-like shape, a pair of terminal housings 61 that cylindrically stand from the one surface 60*c* of the base 60 and accommodates each of engagement portions of the first terminals 20, a nut housing 62 that cylindrically stands from one surface 60*c* of the base 60 and is arranged between a pair of the terminal housings 61 and a tube 63 that cylindrically stands from the one surface 60*c* of the base 60 and is arranged outside a pair of the terminal housings 61 and the nut housing 62. The plate portion 12 of the first terminals 20 is formed with injection in the plate 60, and the tip portion of which projects from the other surface 60*b* of the base 60. As shown in FIG. 4, the nut 17 is formed with injection and attached to the nut housing 62*a*. A taper surface 63*a* is formed on a tip portion away from the side of the plate portion 60 of the tube portion 63. The first inner housing 6 is movably accommodated in the first housing 30 as the plate portion 60 is positioned toward the bottom wall 32 of the first housing 30.

Figure 8:
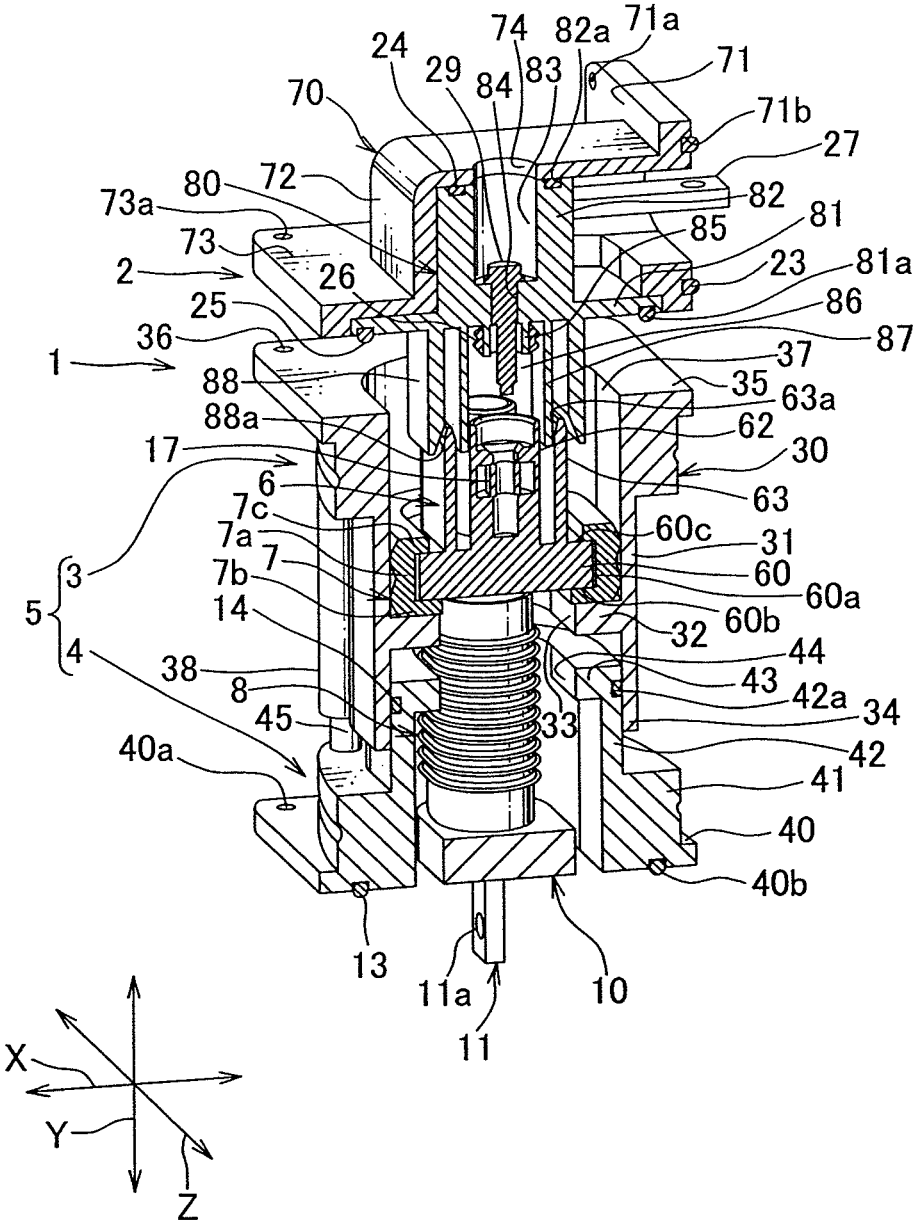
FIG. 8 is a sectional perspective view illustrating the state of halfway engagement between the connector and the mating connector shown in FIG. 7.
Figure 10:
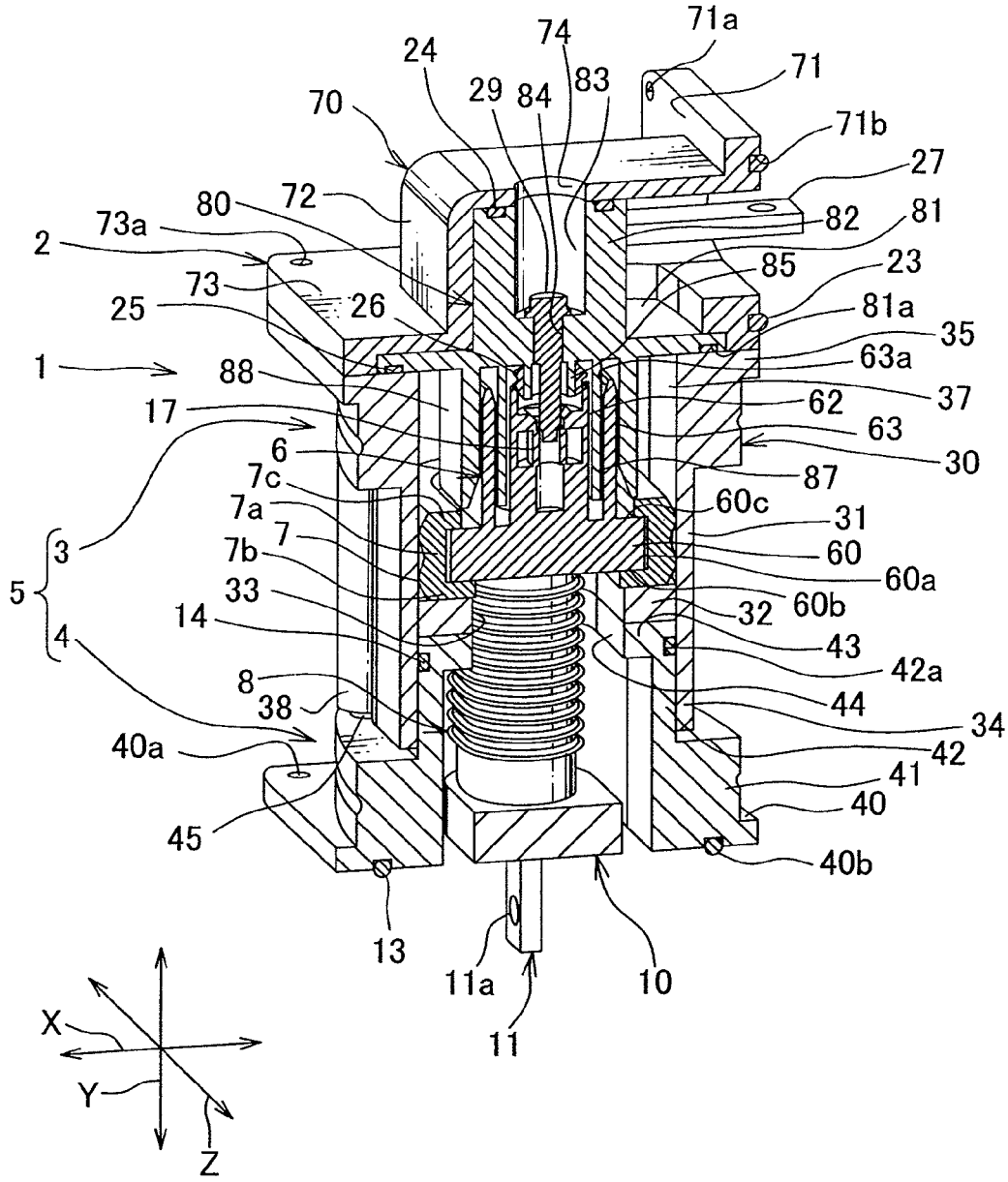
FIG. 10 is a sectional perspective view illustrating the state in which the mating connector shown in FIG. 9 additionally approaches the connector.

As shown in FIGS. 8 to 10, the mating connector 2 and the first inner housing 6 are engaged to each other so that a tube portion 63 of the first inner housing 6 is inserted between the inner tube 87 and the outer tube 88 of the mating connector 2 and each of the terminal housings 61 of the first housing 6 is inserted into each of the terminal housings 86 of the mating connector 2. Since taper surfaces 88*a* and 63*a* are formed on the tip portion of the outer tube 88 and the tube portion 63 respectively, the tube portion 63 is secured to be led into between the inner tube 87 and the outer tube 88. When the flange 3 and overlap portion 81 contact the flange 35 of the connector 1 as the mating connector 2 and the first inner housing 6 engage, the tip of the engagement bolt 29 contacts the inside of the nut 17. As a tool such as a driver is inserted from the through-bore 74 and the recess 83 and the engagement bolt 29 is rotated, the bolt 29 enters into the nut 17 additionally and the first inner housing 6 is pulled up toward the mating connector 2. As shown in FIG. 11, when the engagement bolt 29 is fastened to the nut 17, i.e., the first inner housing 6 is pulled up toward the connector 2 until the tip portion of the tube portion 63 contacts the overlap portion 81, the terminals 28 of the mating connector 2 and the engagement portion of the first terminals 20 of the connector 1 completely engage. Fastening of the engagement bolt 29 with the nut 17 keeps complete engagement of the terminals 28 with the engagement portion of the first terminals 20.

The packing 7 is formed annularly with an elastic transformative rubber and the like, and includes integrally a cylindrical packing body 7*a* that covers the outer circumference surface 60*a* of the base 60 on the first inner housing 6, an annular cover portion 7*b* that is stretched to the one end portion of the packing body 7*a* and covers the outer edge portion of the other surface 60*b* of the base 60, a second annual cover portion 7*c* that is stretched to the other end portion of the packing body 7*a* and covers the outer edge portion of the one surface 60*c* of the base 60. The packing 7 like this is pressed into the first housing 30 with the packing 7 attached to the first inner housing 6. The outer circumference surface of the packing body 7*a* of the packing 7 pressed into the first inner housing 30 coheres to the inner circumference surface of the circumference wall 31, and the cover portion 7*b* thereof is positioned between the bottom surface of the first inner housing 6, i.e., the other surface 60*b* of the base 60 and the bottom wall 32.

In the packing 7 configured as above, as the first inner housing 6 and the first terminals 20 moves toward the bottom wall 32 along the engaging direction Y, the cover portion 7*b* is deformed elastically to be constricted. As the first inner housing 6 and the first terminals 20 moves in the intersectional direction of the engaging direction Y, the packing body 7*a* is deformed elastically to be constricted. The packing 7 thus movably attaches the first inner housing 6 to within the first housing 30 along the engaging direction Y and the intersectional direction of the engaging direction Y. Therefore, the connector 1 can absorb the misregistration produced between the mating connector 2 and the connector 1.

The second terminals 11 are configured in the plate-like shape with metal plate. The second terminals 11 are formed through injection molding in a body 10*a* of the second inner housing 10 mentioned below, and the longitudinal central portion is buried in the body 10*a*. Provided in one end portion projecting from the body portion 10*a* of the second terminals 11 is a bore 11*b* through which a bolt 15 passes (see FIG. 3) when the connection portion 9 is fixed with bolt. Provided in the other end portion projecting from the body portion 10*a* of the second terminals 11 is a bore 11*a* through which a bolt passes when the electro circuit in the inverter case is fixed with bolt.

The second inner housing 10 is made of synthetic resin, and, as shown in FIG. 2, includes integrally the body 10*a* in which a pair of the second terminals 11 is mounted, a pair of fix portions 10*b* to which the second outer housing 4 is fixed with a bolt 22. As shown in FIG. 3, with the second inner housing 10 fixed to the second housing 4, the one end portion of second terminals 11 is accommodated in the second outer housing 4, and the other end portion of the second terminals 11 is positioned outside the second outer housing 4.

As shown in FIGS. 2 and 3, the connection portion 9 includes a braided wire 90 deformable and movable responding to movement of the first inner housing 6 and the first terminals 20, a pair of fix portion 91 and 92 that is attached to the both ends of the braided wire 90. The pair of the fix portion 91 and 92 is configured in the plate-like shape with metal plate. Provided in one of the fix portion 92 electrically connected to the plate portion 12 of the first terminals 20 is a bore 92*a* through which a bolt 16 passes when the plate portion 12 is stacked and fixed with bolt. The pair of the connection portions 9 like this is accommodated in the shielded tube 8 to be shielded each other.

The first terminals 20 that are connected to the second terminals. 11 by the connection portion 9 can move freely with the second terminals 11 fixed, due to deformation of the braided wire 90. I.e., since the present invention includes the connection portion 9 mentioned above, the second terminals 11 does not move even if the first inner housing 6 and the first terminals 20 move due to the engagement of the mating connector 2 with the first inner housing 6. This makes it possible to prevent the stress in the electric circuit connected to the second terminals 11 in the inverter case from producing, or the connection reliability between the second terminals 11 and the electric circuit from lowering. The connector 1 according to the invention can absorb the misregistration with the mating connector 2 and maintain connection condition to electric circuit to which is attached in the case.

An engagement work of the mating connector 2 and the connector 1 is then explained in reference to FIGS. 7 to 11. At first, a motor and an inverter are imposed, and a pair of terminal housings 86, an bolt housing 85, an inner tube 87, an outer tube 88 of the mating connector 2 in FIG. 7 are therefore inserted into the first housing 30 from an opening 37 of the first housing 30 of the first connector 1. At this time, the first inner housing 6 and the first terminals 20 move within the first housing 30 responding to the position of the mating connector 2, which allows the center core of the mating connector 2 and the first inner housing 6 to be adjusted.

The motor and the inverter are further imposed, and therefore as shown in FIG. 9, the flange 73 and the overlap portion 81 of the mating connector 2 contacts the flange 35 of the connector 1, and the tip portion of the engagement bolt 29 is positioned within the nut 1. At this time, An elastic deformation of the cover 7*b* of the packing 7 absorbs an impact load applied to the first inner housing 6 by the mating connector 2, which prevents the first inner housing 6 to crash the bottom wall 32 of the first housing 30 and to be damaged.

Thus, the packing 7 of the invention allows the first inner housing 6 to be attached to the first housing 30 and absorbs impact load at the time of the engagement with the mating connector 2. Note that impact load applied to the first inner housing 6 at the time of the engagement with the mating connector 2 having been integrated with the motor is larger by an motor weight having been added.

Further, in the invention, when the mating connector 2 is shifted toward the connector 1 by assembly error and the like, or the connector 1 toward the mating connector 2, the coil spring 21 in the cylindrical portion 38 is constricted to absorb the misregistration mentioned above shown in FIG. 10. When the coil spring 21 is constricted, the coil spring is constricted with the tip of the engagement bolt 29 contacted to the nut 17 to allow the first outer housing 3 to approach the second outer housing 4

Further, after the imposition of the motor and the inverter is completed, the flange 73 of the mating connector 2 and the flange 35 of the connector 1 are fixed with bolt. As mentioned above, since the bore 73*a* for passing the bolt provided in the flange 73 through is formed larger than the bore for passing the bolt provided in the flange 35, the misregistration in the direction of arrow X or Z between the mating connector 2 and the connector 1 can be absorbed.

At last, a tool such as a driver is inserted from the through-bore 74 of the mating connector 2 and the recess 83 to rotate the engagement bolt 29, fastening the bolt 29 and the nut 17. As shown in FIG. 11, the first inner housing 6 is therefore pulled up toward the mating connector 2, then the terminals 28 of the mating connector 2 and the engagement portion of the first terminals 20 of the first connector 1 is completely engaged. Fastening of the engagement bolt 29 with the nut 17 maintains complete engagement of the terminals 28 with the engagement portion of the first terminals 20. Thus, the mating connector 2 is engaged to the connector 1.

As seen above, in the invention, the terminals 28 of the mating connector 2 and the first terminals 20 can be secured to be electrically connected by the engagement bolt 29 and the nut that is formed in the first inner housing 6 through injection molding. Further, even if the engagement of the terminals 28 of the mating connector 2 with the first terminals 28 cannot be confirmed visually, the engagement therebetween can be secured. In addition, the engagement therebetween can be maintained for long periods.

The connector 1 of the invention does not require wires for connecting to the mating connector 2, i.e., wire harnesses for electrically connecting the inverter to the motor, therefore saving space for accommodating the wires. Further, since the connector 1 of the invention engages with the mating connector 2 as part of the imposition work for the motor and the inverter, process of works for engagement of connectors can be reduced.

Further, though there explained in the embodiment mentioned above is an example that the connector 1 is fixed to the inverter case, the connector of the invention may be fixed to any cases.

Although the present invention has been fully described by way of example with reference to the accompanying drawings, it is to be understood that various changes and modifications will be apparent to those skilled in the art. Therefore, unless otherwise such changes and modifications depart from the scope of the present invention hereafter defied, they should be construed as being included therein.

What is claimed is:

1. A connector comprising:

an outer housing attached to a case;

a first inner housing accommodating a first terminal engaging to a terminal of a mating connector, the first inner housing being accommodated movably in the outer housing in the engaging direction of the first terminal and in the intersectional direction of the engaging direction, said first inner housing being configured to engage with the mating connector;

a second inner housing accommodating a second terminal electrically connected to an electric circuit in the case, and being fixed in the outer housing; and a connection portion made of flexible conductive member to connect the first terminal and the second terminal electrically.

2. The connector as claimed in claim 1, wherein the outer housing comprises:

a first housing that is configured in the tubular shape with a bottom wall, capable of the first inner housing and provided with a through-bore in the bottom wall thereof through which the connection portion passes; and an elastic deformable packing attached to the first inner housing, integrally including: a tubular packing body that is pressed into between an outer circumference surface of the first inner housing and an inner circumference surface of the first housing; and an annular cover positioned between the lower end surface of the first inner housing and the bottom wall of the first housing.

3. The connector as claimed in claim 1, further comprising: a plurality of the first terminals; a plurality of the second terminals; a plurality of the connection portions connecting each of the first terminals and each of the second terminals respectively; and a plurality of isolation tubes that is formed telescopically with isolation material in the tubular shape with bellows and accommodates each of the connection portions respectively.

4. The connector as claimed in claim 2, further comprising:

a plurality of the first terminals; a plurality of the second terminals; a plurality of the connection portions connecting each of the first terminals and each of the second terminals respectively; and a plurality of isolation tubes that is formed telescopically with isolation material in the tubular shape with bellows and accommodates each of the connection portions respectively.

5. The connector as claimed in claim 1, the outer housing comprising: a first outer housing accommodating the first inner housing; and a second outer housing that accommodates the second inner housing and is fixed in the case, and to which the first outer housing is attached movably along the engaging direction of the first terminal, wherein an elastic member is attached to one of the first outer housing and the second outer housing, and biases in the direction away from the other thereof along the engaging direction of the first terminal.

6. The connector as claimed in claim 2, the outer housing comprising: a first outer housing accommodating the first inner housing; and a second outer housing that accommodates the second inner housing and is fixed in the case, and to which the first outer housing is attached movably along the engaging direction of the first terminal, wherein an elastic member is attached to one of the first outer housing and the second outer housing, and biases in the direction away from the other thereof along the engaging direction of the first terminal.

7. The connector as claimed in claim 3, the outer housing comprising: a first outer housing accommodating the first inner housing; and a second outer housing that accommodates the second inner housing and is fixed in the case, and to which the first outer housing is attached movably along the engaging direction of the first terminal, wherein an elastic member is attached to one of the first outer housing and the second outer housing, and biases in the direction away from the other thereof along the engaging direction of the first terminal.

8. The connector as claimed in claim 4, the outer housing comprising: a first outer housing accommodating the first inner housing; and a second outer housing that accommodates the second inner housing and is fixed in the case, and to which the first outer housing is attached movably along the engaging direction of the first terminal, wherein an elastic member is attached to one of the first outer housing and the second outer housing, and biases in the direction away from the other thereof along the engaging direction of the first terminal.

9. The connector as claimed in claim 1, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

10. The connector as claimed in claim 2, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

11. The connector as claimed in claim 3, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

12. The connector as claimed in claim 4, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

13. The connector as claimed in claim 5, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

14. The connector as claimed in claim 6, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

15. The connector as claimed in claim 7, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

16. The connector as claimed in claim 8, wherein a nut is attached to the first inner housing and the mating connector approaches the first inner housing as a bolt passed through a bore provided in the mating connector is inserted into the nut, and fastening of the bolt to the nut allows the terminal of the mating connector and the first terminal to engage with each other and maintain the engagement.

* * * * *